US006943143B2

(12) United States Patent
Kinloch et al.

(10) Patent No.: US 6,943,143 B2
(45) Date of Patent: Sep. 13, 2005

(54) DETERGENT COMPOSITION

(75) Inventors: James Iain Kinloch, Northumberland (GB); Simon John Greener, Tyne & Wear (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/613,285

(22) Filed: Jul. 3, 2003

(65) Prior Publication Data

US 2004/0018953 A1 Jan. 29, 2004

(30) Foreign Application Priority Data

Jul. 3, 2002 (EP) ..... 02254684
Sep. 9, 2002 (EP) ..... 02256237

(51) Int. Cl.[7] ..... C11D 1/75; C11D 3/43

(52) U.S. Cl. ..... 510/503; 510/220; 510/221; 510/439; 510/505; 510/506; 510/457

(58) Field of Search ..... 510/220, 221, 510/439, 503, 505, 506, 457

(56) References Cited

U.S. PATENT DOCUMENTS

| | | | |
|---|---|---|---|
| 3,776,959 | A | 12/1973 | Stalioraitis et al. |
| 4,247,480 | A | 1/1981 | Murata et al. |
| 4,748,275 | A | 5/1988 | Smith et al. |
| 5,130,488 | A | 7/1992 | Smith et al. |
| 5,164,121 | A | 11/1992 | Smith et al. |
| 5,238,609 | A | 8/1993 | Smith et al. |

FOREIGN PATENT DOCUMENTS

| | | | |
|---|---|---|---|
| WO | WO 9220772 | A1 | 11/1992 |
| WO | WO 02/06438 | A1 | 1/2002 |
| WO | WO 02/42400 | A2 | 5/2002 |
| WO | WO 02/42408 | A2 | 5/2002 |

*Primary Examiner*—Gregory R. Del Cotto
(74) *Attorney, Agent, or Firm*—Jeffrey V. Bamber

(57) ABSTRACT

A detergent composition in the form of a substantially anhydrous liquid, gel or paste and which comprises a premix of an amine oxide surfactant and a solvent therefor selected from $C_3$ to $C_{10}$ alkylene and polyalkylene diols and mixtures thereof. The invention also relates to unit dose forms containing the detergent compositions and processes for making a premix for use in said compositions.

1 Claim, No Drawings

DETERGENT COMPOSITION

CROSS REFERENCE TO RELATED APPLICATION

This application claims the benefit of European Application No. 02256237.5, filed on Sep. 9, 2002, and European Application No. 02254684.0, filed on Jul. 3, 2002, the disclosure of which is incorporated by reference.

TECHNICAL FIELD

The present invention is in the field of detergency. In particular, it relates to detergent compositions comprising an amine oxide surfactant. The invention also relates to unit dose forms containing the detergent compositions and processes for making a premix for use in said compositions.

BACKGROUND OF THE INVENTION

Amine oxide surfactants are widely used in commercial cleaning compositions. When formulated into detergents for use in automatic dishwashing they are very effective for grease removal and reduction of filming and spotting on dishware and tableware. These surfactants are produced by oxidation of tertiary amines, the oxidation is carried out in liquid media, therefore if the amine oxide is to be used in solid compositions an after-treatment step, such as spray-drying or evaporation, would be required, increasing the capital cost and the energy requirements of the production process.

Detergency bleach is part of most of the dishwashing products. Bleach species can interact with amine oxide in the dishwashing product, this interaction no only decreases the amount of bleach and amine oxide available for the dishwashing process but also generates amine species given rise to malodour problems.

The syntheses most commonly employed for the production of amine oxides is carried out in aqueous solution, as taught in for example U.S. Pat. No. 4,748,275 and U.S. Pat. No. 4,247,480. The resulting amine oxides are obtained in aqueous liquid, this is valuable for aqueous detergents, however, cannot be readily used in anhydrous liquid detergents. Processes for the preparation of amine oxides in organic solvents are also known in the art. U.S. Pat. No. 3,776,959 discloses a process for the production of amine oxides in non-polar solvents. U.S. Pat. No. 5,130,488 discloses a process for the production of amine oxides in an organic solvent. The organic solvent may be a solvent in which the amine oxide is soluble at the reaction temperature but insoluble at a lower temperature.

Unitised doses of dishwashing detergents, especially water-soluble pouches, capsules and sachets are very attractive to consumers. A challenge that the formulator is faced with when designing water-soluble detergents containing amine oxide surfactants, especially in liquid form, is that the amine oxide needs to be dissolved in a solvent suitable for the dishwashing process, compatible with the material of the water-soluble unit dose form and which will not impair the dissolution of the unit-dose detergent.

SUMMARY OF THE INVENTION

According to a first aspect of the invention, there is provided a detergent composition in the form of a substantially anhydrous liquid, gel or paste and which comprises an amine oxide surfactant and a solvent therefor selected from $C_3$ to $C_{10}$ alkylene and polyalkylene diols and mixtures thereof.

The term "substantially anhydrous" as used herein is intended to include detergent compositions containing less than about 10%, preferably less than about 8% and more preferably less than about 5% of free water by weight of the detergent composition. Free water can be measured by extracting 2 g of the composition into 50 ml of dry methanol at room temperature for 20 minutes and then analysis a 1 ml aliquot of the methanol by Karl Fischer titration.

Amine oxides for use herein have the formula:

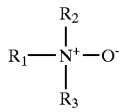

where $R_1$ is selected from an alkyl, hydroxyalkyl, acylamidopropyl and alkyl phenyl groups containing an average of at least 12 carbon atoms in the alkyl moiety; and $R_2$ and $R_3$ are independently selected from $C_{1-3}$ alkyl and/or $C_{2-3}$ hydroxyalkyl groups and polyethylene oxide groups containing from 1 to 3, preferably 1, ethylene oxide units. Preferred amine oxides are those wherein the $R_1$ alkyl moiety of the amine oxide contains an average of from 13 to 17 carbon atoms.

Preferred amine oxides from the view point of grease removal and filming and spotting reduction as well as for their environmental profile are tetradecyl dimethyl amine oxide, hexadecyl dimethyl amine oxide and mixtures thereof.

The detergent composition of the invention comprises a solvent in which the amine oxide is soluble. The solvent used in the detergent compositions of the invention is selected from $C_3$ to $C_{10}$ alkylene and polyalkylene diols and mixtures thereof. Preferred solvents for use herein are cyclic or non-cyclic $C_5$ to $C_{10}$ diols preferably selected from 1,4-cyclohexane dimethanol, 1,6-hexanediol, 1,7-heptanediol and mixtures thereof. A preferred solvent is 1,4-cyclohexane dimethanol. This solvent presents excellent compatibility with pouch, capsule and sachet materials as well as with detergent components. Additionally, it favours the dissolution of the detergent composition by avoiding gel phase formation upon dilution of the amine oxide in the wash liquor.

Other preferred solvents for use herein are propylene glycols, preferably dipropylene glycol. Dipropylene glycol also presents excellent compatibility with pouch, capsule and sachet materials as well as with detergent components.

The amine oxide surfactant and solvent generally takes the form of a premix which is formed prior to addition of other components of the composition such as suds suppresser, as described herein below.

Automatic dishwashing appliances work in a spray mode. The spray action, combined with some soils resulting from the cleaning process and some of the detergent ingredients, tends to cause suds, which in turn reduces the cleaning action. Although the amine oxides suitable for the present invention have a good suds profile, the suds can be further diminished by the addition of a suds suppresser. Thus, according to a preferred embodiment of the present invention, there is provided a detergent composition further comprising a suds-suppresser.

In a preferred embodiment of the invention there is provided a unit-dose detergent product in the form of a water-soluble pouch, capsule or sachet containing the detergent composition of the invention. The detergent composition would preferably be in the form of a fluid, especially liquid, gel or paste. The viscosity of the fluid can easily be designed in order to achieve a desired delivery time. For situations in which a rapid delivery of the detergent is desired, a liquid with a viscosity from about 10 to about 1,000 m Pa s (as measured at shear rate of 1 $s^{-1}$ using a Contraves Rheometer with 40 mm diameter parallel plate at 25° C.) can be designed, this would be useful, for example for dishwashing processes with short cycles. For situations in which the retention of the detergent fluid is desired, for example in the case of dishwashing processes (performed in a dishwasher having a dispenser which allows water through) including a pre-wash step and where the delivery of the detergent is not desired until the main wash, a high viscosity detergent fluid is desired, having a viscosity of for example from about 1,000 m Pa s to about 100,000 m Pa s (as measured at shear rate of 1 $s^{-1}$ using a Contraves Rheometer with 40 mm diameter parallel plate at 25° C.).

In preferred embodiments the unit-dose detergent product is in the form of a multi-compartment pouch, capsule or sachet having at least two different compartments wherein at least one of the compartments contains the detergent composition of the invention. In a preferred embodiment, the multi-compartment pouch comprises a compartment containing the detergent of the invention in liquid form and another compartment containing a detergent in solid form preferably comprising a detergency bleach.

According to another aspect of the invention, there is provided a detergent product in the form of powder/liquid dual-compartment pouch wherein the liquid composition comprises an amine oxide surfactant, a solvent therefor preferably selected from $C_3$ to $C_{10}$ alkylene and polyalkylene diols and mixtures thereof, and a suds suppresser and wherein the powder composition comprises a detergency bleach and additional suds suppresser or other post-added liquid capable of acting as a binder for the powder composition. The weight ratio of amine oxide surfactant to suds suppresser is from about 1:20 to about 1:1, preferably from about 1:10 to about 1:6 in the liquid compartment. The powder composition preferably comprises from 0.5 to 20%, more preferably from 1 to 5% by weight of the powder composition of suds suppresser or other liquid acting as a binder. The amine oxide surfactant and solvent are preferably provided in the form of a premix as described hereinabove.

The suds suppresser not only reduces the suds formation but also acts as a binder for the powder phase and provides shine benefits. From a processability point of view the suds suppresser would ideally be located in the powder compartment. The powder composition can give rise to dusting problems, which translates, among other things, into deficient sealing of the pouch. The manufacture of the powder compartment usually requires a tampering step. Tampering the powder produces a pouch having a better shape and aesthetics if carried out on slightly wet powder. The suds suppresser or other liquid binder also reduces segregation of the powder. However, if the suds suppresser is located solely in the powder compartment, it may be delivered into the wash liquor later than the components of the liquid compartment, given rise to suds formation, impacting not only on cleaning performance but also potentially generating water leakage from the dishwasher. It has been surprisingly found that pouches having an optimum stability profile and providing an optimum cleaning and finishing can be achieved by placing part of the suds suppresser in the liquid compartment and part in the powder compartment. A preferred pouch comprises amine oxide and suds suppresser in a weight ratio of from about 1:10 to about 1:6 in the liquid compartment and from about 1 to about 5% by weight of the powder composition of suds suppresser in the powder compartment. The weight ratio of powder composition to liquid composition is from about 30:1 to about 1:30, preferably from about 20:1 to about 5:1.

According to another aspect of the invention, there is provided a surfactant premix, suitable for use in making the detergent compositions of the invention. The amine oxide solvent are preferably in a weight ratio of from about 10:1 to about 0.5:2, preferably from about 5:1, to about 1:2 and more preferably from about 4:1 to about 2:2. A surfactant premix comprising such a high level of amine oxide surfactant is especially useful in formulating concentrated or compact liquid detergent compositions.

According to another aspect of the invention there is provided a process for making the surfactant premix, used to make the detergent compositions of the invention, reacting a tertiary amine with an aqueous solution of hydrogen peroxide in the presence of solvent for the resulting amine oxide surfactant. The product obtained by this process is compatible with pouch, capsule and sachet materials and improves the dissolution of the materials in water.

There is also provided another process for making the surfactant premix, used to make the detergent compositions of the invention, mixing an aqueous solution of amine oxide with a solvent therefor followed by removing water from the resulting mixture. This process permits the production of the surfactant premix, used to make the detergent compositions of the invention, starting from readily available commercial materials.

According to the final aspect of the invention, the use of the unit-dose detergent products described hereinabove for automatic dishwashing is provided.

DETAILED DESCRIPTION OF THE INVENTION

The present invention envisages detergent compositions comprising an amine oxide surfactant and a solvent therefor. Unit dose forms containing the detergent compositions and processes for making a premix for use in said compositions are also envisaged herein.

The ingredients of the detergent compositions of the invention are described hereinbelow:

Amine Oxide

Amine oxides suitable for the detergent compositions of the invention have the formula:

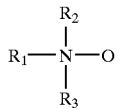

where $R_1$ is selected from an alkyl, hydroxyalkyl, acylamidopropyl and alkyl phenyl group, or mixtures thereof, containing an average of at least 12, preferably from 13 to 17, more preferably from 14 to 16 carbon atoms in the alkyl moiety; and $R_2$ and $R_3$ are independently $C_{1-3}$ alkyl or $C_{2-3}$ hydroxyalkyl groups, or a polyethylene oxide group containing from 1 to 3, preferably 1, ethylene oxide groups. Particularly preferred are amine oxides wherein $R_1$ is a $C_{12-18}$ alkyl and $R_2$ and $R_3$ are methyl or ethyl. Preferred amine oxides for use herein are tetradecyl dimetyl amine oxide, hexadecyl dimethyl amine oxide and mixtures thereof.

The amine oxide is typically present at a total level of from about 0.01% to about 12% by weight, more preferably from about 0.1% to about 5% by weight, most preferably from about 0.3% to about 3% by weight of composition. In multi-compartment embodiments the level of amine oxide is from about 3% to about 12%, preferably from about 5% to about 9% by weight of the detergent composition in liquid form.

Solvent

A solvent for the amine oxide is a substance with the ability to solubilise and maintain solubilised the amine oxide under storage conditions. The solvents used in the present invention preferably avoid gel phase formation and facilitate the dissolution of the amine oxide in the wash liquor. Solvents for use herein are selected from $C_3$ to $C_{10}$ alkylene and polyalkylene diols and mixtures thereof. Preferred solvents for use herein are cyclic or non-cyclic $C_5$ to $C_{10}$ diol preferably selected from 1,4-cyclohexane dimethanol, 1,6-hexanediol, 1,7-heptanediol and mixtures thereof. Other preferred solvents for use herein are propylene glycols, especially dipropylene glycol.

Other ingredients suitable for use herein are described herein below. These ingredients can be used in the liquid, gel or paste detergent compositions of the invention and they can also be used in solid detergent compositions in the case of multi-compartment embodiments.

Surfactant

The compositions and products of the invention may comprise other surfactants in addition to the amine oxide surfactants. The additional surfactant is preferably low foaming by itself or in combination with other components (i.e. suds suppressers). Surfactants suitable herein include anionic surfactants such as alkyl sulfates, alkyl ether sulfates, alkyl benzene sulfonates, alkyl glyceryl sulfonates, alkyl and alkenyl sulphonates, alkyl ethoxy carboxylates, N-acyl sarcosinates, N-acyl taurates and alkyl succinates and sulfosuccinates, wherein the alkyl, alkenyl or acyl moiety is $C_5$–$C_{20}$, preferably $C_{10}$–$C_{18}$ linear or branched; cationic surfactants such as chlorine esters (U.S. Pat. No. 4,228,042, U.S. Pat. No. 4,239,660 and U.S. Pat. No. 4,260,529) and mono $C_6$–$C_{16}$ N-alkyl or alkenyl ammonium surfactants wherein the remaining N positions are substituted by methyl, hydroxyethyl or hydroxypropyl groups; low and high cloud point nonionic surfactants and mixtures thereof including nonionic alkoxylated surfactants (especially ethoxylates derived from $C_6$–$C_{18}$ primary alcohols), ethoxylated-propoxylated alcohols (e.g., BASF Poly-Tergent® SLF18), epoxy-capped poly(oxyalkylated) alcohols (e.g., BASF Poly-Tergent® SLF18B—see WO-A-94/22800), ether-capped poly(oxyalkylated) alcohol surfactants, and block polyoxyethylene-polyoxypropylene polymeric compounds such as PLURONIC®, REVERSED PLURONIC®, and TETRONIC® by the BASF-Wyandotte Corp., Wyandotte, Mich.; amphoteric surfactants such as alkyl amphocarboxylic surfactants such as Miranol™ C2M; and zwitterionic surfactants such as the betaines and sultaines; and mixtures thereof. Surfactants suitable herein are disclosed, for example, in U.S. Pat. No. 3,929,678, U.S. Pat. No. 4,259,217, EP-A-0414 549, WO-A-93/08876 and WO-A-93/08874. Surfactants are typically present at a level of from about 0.2% to about 30% by weight, more preferably from about 0.5% to about 10% by weight, most preferably from about 1% to about 5% by weight of composition. Preferred surfactants for use herein are low foaming and include low cloud point nonionic surfactants and mixtures of higher foaming surfactants with low cloud point nonionic surfactants which act as suds suppresser therefor.

Builder

Builders suitable for use in the detergent compositions or products of the invention include builder which forms water-soluble hardness ion complexes (sequestering builder) such as citrates and polyphosphates e.g. sodium tripolyphosphate and sodium tripolyphosphate hexahydrate, potassium tripolyphosphate and mixed sodium and potassium tripolyphosphate salts and builder which forms hardness precipitates (precipitating builder) such as carbonates e.g. sodium carbonate. The builder is typically present at a level of from about 30 to about 80%, preferably from about 40 to about 70% by weight of composition. It is also preferred that the ratio of sequestering builder to precipitating builder is from about 10:1 to about 1:1, preferably from about 8:1 to 2:1.

Silicates

Silicates suitable for use in the detergent compositions or products of the invention include partially water-soluble or insoluble builders such as crystalline layered silicates (EP-A-0164514 and EP-A-0293640) and aluminosilicates inclusive of Zeolites A, B, P, X, HS and MAP.

Amorphous sodium silicates having an $SiO_2$:$Na_2O$ ratio of from 1.8 to 3.0, preferably from 1.8 to 2.4, most preferably 2.0 can also be used herein although highly preferred from the viewpoint of long term storage stability are compositions containing less than about 22%, preferably less than about 15% total (amorphous and crystalline) silicate.

Enzyme

Preferred enzymes for use in the detergent compositions or products of the invention include proteolitic enzymes such as Esperase®, Alcalase®, Durazym® and Savinase® (Novo) and Maxatase®, Maxacal®, Properase® and Maxapem® (Gist-Brocades). Other enzymes suitable for use herein include bacterial and fungal cellulases such as Carezyme and Celluzyme (Novo Nordisk A/S); peroxidases; lipases such as Amano-P (Amano Pharmaceutical Co.), M1 Lipase® and Lipomax® (Gist-Brocades) and Lipolase® and Lipolase Ultra® (Novo); cutinases; α and β amylases such as Purafect Ox Am® (Genencor) and Termamyl®, Ban®, Fungamyl®, Duramyl®, and Natalase® (Novo); pectinases; and mixtures thereof. Enzymes are preferably added herein as prills, granulates, or cogranulates at levels typically in the range from about 0.0001% to about 4% pure enzyme by weight of composition.

Bleaching Agent

Bleaching agents suitable for use in the detergent compositions or products of the invention include chlorine and oxygen bleaches, especially inorganic perhydrate salts such as sodium perborate mono-and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from about 1% to about 40% by weight, preferably from about 2% to about 30% by weight and more preferably from abut 5% to about 25% by weight of composition. Preferred for use herein, as part of the carbonate source, is sodium percarbonate. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pemonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807). Bleach precursors are typically incorporated at levels in the range from about 0.5% to about 25%, preferably from about 1% to about 10% by weight of composition while the preformed organic peroxyacids themselves are typically incorporated at levels in the range from 0.5% to 25% by weight, more preferably from 1% to 10% by weight of composition. Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes(U.S. Pat. No. 4,810,410). Bleaching agents are preferably incorporated into detergent compositions in solid form.

Low Cloud Point Non-Ionic Surfactants and Suds Suppressers

The suds suppressers suitable for use in the detergent compositions or products of the invention include nonionic surfactants having a low cloud point. "Cloud point", as used herein, is a well known property of nonionic surfactants which is the result of the surfactant becoming less soluble with increasing temperature, the temperature at which the appearance of a second phase is observable is referred to as the "cloud point" (See Kirk Othmer, pp. 360–362). As used herein, a "low cloud point" nonionic surfactant is defined as a nonionic surfactant system ingredient having a cloud point of less than 30° C., preferably less than about 20° C., and even more preferably less than about 10° C., and most preferably less than about 7.5° C. Typical low cloud point nonionic surfactants include nonionic alkoxylated surfactants, especially ethoxylates derived from primary alcohol, and polyoxypropylene/polyoxyethylene/polyoxypropylene (PO/EO/PO) reverse block polymers. Also, such low cloud point nonionic surfactants include, for example, ethoxylated-propoxylated alcohol (e.g., BASF Poly-Tergent® SLF18) and epoxy-capped poly(oxyalkylated) alcohols (e.g., BASF Poly-Tergent® SLF18B series of nonionics, as described, for example, in U.S. Pat. No. 5,576,281).

Preferred low cloud point surfactants are the ether-capped poly(oxyalkylated) suds suppresser having the formula:

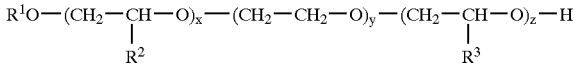

wherein $R^1$ is a linear, alkyl hydrocarbon having an average of from about 7 to about 12 carbon atoms, $R^2$ is a linear, alkyl hydrocarbon of about 1 to about 4 carbon atoms, $R^3$ is a linear, alkyl hydrocarbon of about 1 to about 4 carbon atoms, x is an integer of about 1 to about 6, y is an integer of about 4 to about 15, and z is an integer of about 4 to about 25.

Other low cloud point nonionic surfactants are the ether-capped poly(oxyalkylated) having the formula:

$$R_I O(R_{II}O)_n CH(CH_3)OR_{III}$$

wherein, $R_I$ is selected from the group consisting of linear or branched, saturated or unsaturated, substituted or unsubstituted, aliphatic or aromatic hydrocarbon radicals having from about 7 to about 12 carbon atoms; $R_{II}$ may be the same or different, and is independently selected from the group consisting of branched or linear $C_2$ to $C_7$ alkylene in any given molecule; n is a number from 1 to about 30; and $R_{III}$ is selected from the group consisting of:

(i) a 4 to 8 membered substituted, or unsubstituted heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

(b) provided that when $R^2$ is (ii) then either: (A) at least one of $R^1$ is other than $C_2$ to $C_3$ alkylene; or (B) $R^2$ has from 6 to 30 carbon atoms, and with the further proviso that when $R^2$ has from 8 to 18 carbon atoms, R is other than $C_1$ to $C_5$ alkyl.

In the case of multi-compartment pouch, capsule or sachet embodiment, the suds suppresser is incorporated into the liquid, gel or paste detergent composition comprising the amine oxide surfactant and the solvent therefor.

Other suitable components for use in the detergent compositions or products of the invention include organic polymers having dispersant, anti-redeposition, soil release or other detergency properties invention in levels of from about 0.1% to about 30%, preferably from about 0.5% to about 15%, most preferably from about 1% to about 10% by weight of composition. Preferred anti-redeposition polymers herein include acrylic acid containing polymers such as Sokalan PA30, PA20, PA15, PA10 and Sokalan CP10 (BASF GmbH), Acusol 45N, 480N, 460N (Rohm and Haas), acrylic acid/maleic acid copolymers such as Sokalan CP5 and acrylic/methacrylic copolymers. Preferred anti-scaling polymers include sulphonated polymers such as Alcosperse 240. Preferred soil release polymers herein include alkyl and hydroxyalkyl celluloses (U.S. Pat. No. 4,000,093), polyoxyethylenes, polyoxypropylenes and copolymers thereof, and nonionic and anionic polymers based on terephthalate esters of ethylene glycol, propylene glycol and mixtures thereof.

Heavy metal sequestrants and crystal growth inhibitors are suitable for use in the detergents of the invention in levels generally from about 0.005% to about 20%, preferably from about 0.1% to about 10%, more preferably from about 0.25% to about 7.5% and most preferably from about 0.5% to about 5% by weight of composition, for example diethylenetriamine penta (methylene phosphonate), ethylenediamine tetra(methylene phosphonate) hexamethylenediamine tetra(methylene phosphonate), ethylene diphosphonate, hydroxy-ethylene-1,1-diphosphonate, nitrilotriacetate, ethylenediaminotetracetate, ethylenediamine-N,N'-disuccinate in their salt and free acid forms.

The detergent compositions herein can contain a corrosion inhibitor such as organic silver coating agents in levels of from about 0.05% to about 10%, preferably from about 0.1% to about 5% by weight of composition (especially paraffins such as Winog 70 sold by Wintershall, Salzbergen, Germany), nitrogen-containing corrosion inhibitor compounds (for example benzotriazole and benzimadazole—see GB-A-1137741) and Mn(II) compounds, particularly Mn(II) salts of organic ligands in levels of from about 0.005% to about 5%, preferably from about 0.01% to about 1%, more preferably from about 0.02% to about 0.4% by weight of the composition.

Other suitable components for the detergent compositions or products of the invention include colorants, water-soluble bismuth compounds such as bismuth acetate and bismuth citrate at levels of from about 0.01% to about 5%, enzyme stabilizers such as calcium ion, boric acid, propylene glycol and chlorine bleach scavengers at levels of from about 0.01% to about 6%, lime soap dispersants (see WO-A-93/08877), suds suppressers (see WO-93/08876 and EP-A-0705324), polymeric dye transfer inhibiting agents, optical brighteners, perfumes, fillers and clay.

Liquid detergent compositions can contain low quantities of low molecular weight primary alcohols such as methanol, ethanol, propanol and isopropanol can be used in the liquid detergent of the present invention. Other suitable carrier solvents used in low quantities includes glycerol, ethylene glycol, sorbitol and mixtures thereof.

Pouch, Capsule or Sachet Material

The pouches, capsules or sachets herein can be of any form which is suitable to hold the compositions, e.g. without allowing the substantial release of composition from the pouch prior to use. The exact execution will depend on, for example, the type and amount of the composition in the pouch, the number of compartments in the pouch, the characteristics required from the pouch to hold, protect and deliver or release the compositions.

The pouch, capsule or sachet is preferably made of a material which is soluble or dispersible in water, and has a water-solubility of at least 50%, preferably at least 75% or even at least 95%, as measured by the method set out here after using a glass-filter with a maximum pore size of 20 microns.

50 grams±0.1 gram of pouch, capsule or sachet material is added in a pre-weighed 400 ml beaker and 245 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the % solubility or dispersability can be calculated.

Preferred pouch, capsule or sachet materials are polymeric materials, preferably polymers which are formed into a film or sheet. The pouch, capsule or sachet can, for example, be obtained by casting, blow-moulding, extrusion or blown extrusion of the polymeric material, as known in the art.

Preferred polymers, copolymers or derivatives thereof suitable for use as pouch, capsule or sachet material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%.

Mixtures of polymers can also be used. This may in particular be beneficial to control the mechanical and/or dissolution properties of the compartment or pouch, depending on the application thereof and the required needs. For example, it may be preferred that a mixture of polymers is present in the material of the compartment, whereby one polymer material has a higher water-solubility than another polymer material, and/or one polymer material has a higher mechanical strength than another polymer material. It may be preferred that a mixture of polymers is used, having different weight average molecular weights, for example a mixture of PVA or a copolymer thereof of a weight average molecular weight of 10,000–40,000, preferably around 20,000, and of PVA or copolymer thereof, with a weight average molecular weight of about 100,000 to 300,000, preferably around 150,000.

Also useful are polymer blend compositions, for example comprising hydrolytically degradable and water-soluble polymer blend such as polylactide and polyvinyl alcohol, achieved by the mixing of polylactide and polyvinyl alcohol, typically comprising 1–35% by weight polylactide and approximately from 65% to 99% by weight polyvinyl alcohol, if the material is to be water-dispersible, or water-soluble. It may be preferred that the PVA present in the film is from 60–98% hydrolysed, preferably 80% to 90%, to improve the dissolution of the material.

Most preferred pouch materials are PVA films known under the trade reference Monosol M8630, as sold by Chris-Craft Industrial Products of Gary, Ind., US, and PVA films of corresponding solubility and deformability characteristics. Other films suitable for use herein include films known under the trade reference PT film or the K-series of films supplied by Aicello, or VF-HP film supplied by Kuraray.

The water-soluble film herein may comprise other additive ingredients than the polymer or polymer material. For example, it may be beneficial to add plasticisers, for example glycerol, ethylene glycol, diethyleneglycol, propylene glycol, sorbitol and mixtures thereof, additional water, disintegrating aids. It may be useful that the pouch or water-soluble film itself comprises a detergent additive to be delivered to the wash water, for example organic polymeric soil release agents, dispersants, dye transfer inhibitors.

Process for Making the Surfactant Premix

A tertiary amine is oxidized with an aqueous solution of hydrogen peroxide in the presence of a solvent selected from $C_3$ to $C_{10}$ alkylene and polyalkylene diols and mixtures thereof. A preferred solvent for use in this process is 1,4-cyclohexane dimethanol. Another preferred solvent is dipropylene glycol. Tertiary amines suitable for the process of the invention can be those described in U.S. Pat. No. 5,130,488 column 2, lines 29 to 51. The aqueous solution of hydrogen peroxide should be as concentrated as possible in order to give an end product with minimum water content, however safety needs to be taken into consideration when choosing the concentration of the solution. Thus hydrogen peroxide solutions for use herein would have a concentration of at least 30%, preferably at least 40% by weight. The tertiary amine and the hydrogen peroxide are preferably in a molar ratio of from about 1:1 to about 2:1, preferably from about 1:1.1 to about 1:1.3.

The solvent may be present throughout the reaction. However, it is generally preferred to insure minimization of the amount of solvent used by initiating the reaction in the absence of the solvent and then gradually adding it during the course of the reaction only as required to maintain the reaction mixture fluid and stirrable. Preferably the viscosity of the mixture should be kept below 30,000 mPa s, more preferably below 10,000 mPa s and even more preferably below 1,000 mPa s, as measured under process conditions. The measurement can be taken on-line or by taking a sample of the corresponding mixture and measuring the viscosity at the temperature of the reaction and at shear rate corresponding to the stirring conditions of the process, using for example a Contraves Rheometer with 40 mm diameter parallel plate.

The surfactant premix can be advantageously used in a wide range of detergent products including manual and automatic dishwashing products, shampoos, laundry products and hard surface cleaning products. The premix can be efficiently used in anhydrous liquid products or alternatively it can be easily dried and converted into powder for use in solid products. The surfactant premix is easily processable (due to the low viscosity) and its compatibility with most of the detergent ingredients permits great formulation flexibility.

Alternative the surfactant premix of the invention can be made by mixing and aqueous solution of amine oxide with a solvent selected from $C_3$ to $C_{10}$ alkylene and polyalkylene diols and mixtures thereof, preferably 1,4-cyclohexane dimethanol or dipropylene glycol followed by removing water from this mixture. Water can be removed by drying, for example spray-drying or evaporation.

EXAMPLES

Abbreviations Used in Examples

In the examples, the abbreviated component identifications have the following meanings:

| | |
|---|---|
| Carbonate: | Sodium carbonate |
| STPP: | Sodium tripolyphosphate |
| Silicate: | Amorphous Sodium Silicate ($SiO_2$:$Na_2O$ = from 2:1 to 4:1) |
| Alcosperse 240: | Sulfonated polymer available from Alco Chemical, 40–45% solids |
| Percarbonate: | Sodium percarbonate of the nominal formula $2Na_2CO_3.3H_2O_2$ |
| TAED: | Tetraacetylethylenediamine |
| Amylase: | α-amylase available from Novo Nordisk A/S |
| Protease: | protease available from Novo Nordisk A/S |
| SLF18: | low foaming surfactant available from BASF |
| LF404: | low foaming surfactant available from BASF |
| $C_{14}$AO: | tetradecyl dimethyl amine oxide |
| $C_{16}$AO: | hexadecyl dimethyl amine oxide |
| CHDM: | 1,4-cyclohexanedimethanol |

In the following examples all levels are quoted in grams.

Examples 1 to 5

The compositions of examples 1 to 5 are made in the form of two compartment PVA pouches. The first compartment contains a solid composition and the second compartment contains a liquid composition. The pouch material is made from a Monosol M8630 film as supplied by Chris-Craft Industrial Products. The liquid composition is made by adding the amine oxide/solvent premix to additional solvent, followed by the addition of the rest of the components. The amine oxide/solvent (either 1,4-cyclohexanedimethanol or dipropylene glycol) are in a weight ratio of 3.35:1, in the premix.

| Example | 1 | 2 | 3 | 4 | 5 | 6 |
|---|---|---|---|---|---|---|
| Solid composition | | | | | | |
| STPP | 10.0 | 10.0 | 10.0 | 10.5 | 9.5 | 10.0 |
| Silicate | 1.0 | 1.0 | 1.0 | 1.0 | 1.0 | 1.0 |
| Carbonate | 2.0 | 2.0 | 2.0 | 2.0 | 2.5 | 2.0 |
| Alcosperse 240 | | | 1.0 | 1.0 | 1.0 | 1.0 |
| $C_{16}$AO | 0.2 | | | | | |
| $C_{14}$AO | | | | | | |
| SLF18 | 1.0 | | | | | 0.80 |
| LF404 | | | | | | |
| PCO | 2.5 | 2.5 | 2.5 | 2.5 | 2.5 | 2.5 |
| TAED | 0.25 | 0.25 | 0.25 | 0.25 | 0.25 | 0.25 |
| Amylase | 0.4 | | 0.4 | 0.4 | 0.4 | 0.35 |
| Protease | 0.8 | 0.8 | 0.8 | 0.8 | 0.8 | 0.55 |
| Perfume | 0.05 | 0.05 | 0.05 | 0.05 | 0.05 | 0.05 |
| Total | 18.15 g | 16.6 g | 19.15 g | 19.65 g | 19.15 g | 18.5 g |
| Liquid composition | | | | | | |
| CHDM | | | 0.1 | 0.75 | 0.8 | |
| DPG | 0.8 | 0.5 | 0.65 | | | 0.79 |
| $C_{16}$AO | 0.2 | | 0.2 | | 0.2 | |
| $C_{14}$AO | | 0.3 | | 0.2 | | 0.15 |
| SLF18 | | | 1.0 | 1.0 | | 0.95 |
| LF404 | | | | | 0.8 | |
| Alcosperse 240 | 0.8 | 0.9 | | | | |
| Amylase | | 0.4 | | | | |
| Dye | 0.1 | 0.1 | 0.05 | 0.05 | 0.1 | 0.01 |
| Total | 1.9 g | 2.0 g | 2.0 g | 2.0 g | 1.9 g | 1.9 g |

What is claimed is:

1. A process for making a surfactant premix comprising an amine oxide surfactant and 1,4-cyclohexanedimethanol in a weight ratio of from about 5:1 to about 1:2 comprising the step of reacting a tertiary amine with an aqueous solution of at least about 40% by weight of hydrogen peroxide in the presence of 1,4-cyclohexanedimethanol wherein the tertiary amine and the hydrogen peroxide are in a molar ratio of from about 1:1 to about 2:1 and wherein the level of solvent is adjusted such that the reaction mixture has a viscosity of less than about 30,000 mPa $s^{-1}$, as measured under process conditions.

* * * * *